US005597252A

United States Patent [19]

Ito et al.

[11] Patent Number: 5,597,252

[45] Date of Patent: Jan. 28, 1997

[54] COSMETIC CONTAINER

[75] Inventors: Kenichi Ito, Funabashi; Hirobumi Matayoshi, Toride, both of Japan

[73] Assignee: Hidan Co., Japan

[21] Appl. No.: 503,122

[22] Filed: Jul. 17, 1995

[30] Foreign Application Priority Data

Jul. 18, 1994 [JP] Japan ..... 6-187766

[51] Int. Cl.[6] ..... A45D 40/06; A45D 40/04

[52] U.S. Cl. ..... 401/78; 401/87

[58] Field of Search ..... 401/78, 87

[56] References Cited

U.S. PATENT DOCUMENTS 4,603,989 8/1986 Ackerman et al. ..... 401/78

FOREIGN PATENT DOCUMENTS 889093 12/1943 France ..... 401/78

2639260 5/1990 France ..... 401/78

*Primary Examiner*—Steven A. Bratlie

*Attorney, Agent, or Firm*—Marshall & Melhorn

[57] ABSTRACT

An outer body surrounds a main body and is rotatable with respect to the main body to move up and down a cosmetic holder received in the main body. A casing surrounds the outer body and is rotatable simultaneously with the outer body. The bottom end of the main body is enlarged to form a circumferentially outward projecting bottom extension to be engaged within an annular recess formed cooperatively by the lower end portions of the outer body and the casing. The bottom extension preferably comprises a cylindrical wall portion and an enlarged bead portion formed in the middle of the cylindrical wall portion and projecting outwardly therefrom.

10 Claims, 9 Drawing Sheets

COSMETIC CONTAINER

BACKGROUND OF THE INVENTION

1. Field of the Invention

The present invention relates to a cosmetic container for receiving a stick-like cosmetic such as a lipstick, which can smoothly extract and retract a stick-like cosmetic such as a lipstick accommodated therein 2. Description of the Prior Art As a main body of a conventional cosmetic container, a cylindrical body formed by pressing a flat plate, namely a so-called pressing pipe, has been used. However, a great number of steps are required for manufacturing the pressing pipe, and it is difficult to make the cylindrical body to have a cross-section of a complete circle. Therefore, in order to reduce the number of the manufacturing steps, to improve dimensional precision of the main body, and to smoothen extraction and retraction of the cosmetic relative to the container, currently a straight pipe formed by drawing is used as the main body.

FIG. 10 shows an example of a prior art cosmetic container using a straight pipe as a main body.

As shown in FIG. 10, within a casing 100 having an upper open end, a main body 101 composed of a straight pipe formed by drawing is arranged co-axially with the casing 100 and relatively rotatably therewith. There is a space between the casing 100 and the main body 101. A cylindrical outer body 105 provided with a continuous spiral groove 107 on an inner peripheral surface thereof is arranged between the casing 100 and the main body 101. The outer body 105 is integrally fitted to the bore of the casing 100. An insert sleeve 103 is integrally fixed to the upper end portion of the outer body 105 to rotatably surround the main body 101. Within the main body 101, a cosmetic holder 109 for receiving and holding a cosmetic is received. Diametrical projections 111, 111 opposed to each other are provided at the lower end portion of the cosmetic holder 109. These projections 111, 111 pass through elongated slots 113, 113 provided in the lower portion of the main body 101 to engage with the spiral groove 107. On the outer periphery of the center portion of the main body 101 is formed a projecting bead 106 which is engaged with an internal recess of the outer body 105 to prevent removal or separation of the main body 101. Reference numeral 116 indicates a cap for detachably closing the upper open end of the container.

In use, by rotating an integral assembly comprising the casing 100, the outer body 105 and the insert sleeve 103, the projections 111, 111 in engagement with the spiral groove 107 are guided along the slots 113, 113 of the main body 101 to move up and down, to achieve extraction and retraction of the cosmetic holder 109.

In such a conventional cosmetic container, the outer body 105 is in contact with the main body 101, and the insert sleeve 103 is in contact with the outer body 105 and the main body 101, respectively.

However, a straight pipe manufactured by a drawing should inevitably have a certain degree of diametrical dimensional errors. The extraction and retraction property of the cosmetic container is greatly governed by frictional resistance between the main body 101 and the outer body 105 especially at the abutment portion between the bead 106 and the recess, which, in turn, varies depending upon dimensional relationship between the main body 101, the outer body 105 and the insert sleeve 103.

For example, when a diameter of the insert sleeve 103 is relatively small to exert an excessive degree of the frictional resistance between the main body 101 and the outer body 105, the cosmetic holder 109 can not be smoothly moved.

When a diameter of the insert sleeve 103 is relatively large, the frictional resistance between the main body 101 and the outer body 105 in the abutment portion is decreased. In this case, the cosmetic holder 109 can be moved too easily, and a user would have an uncomfortable feeling in cosmetic retracting and extracting operation. Further, airtightness of the container is degraded, and there is a possibility of deteriorating the cosmetic by an invasion of the open air.

In another prior art, a lubricant such as silicon grease is applied into the contacts between the respective constituents of the container in order to smoothen extraction and retraction of the cosmetic. However, use of silicon grease is not desirable, because the cosmetic would deteriorate under the influence of components of the silicon grease during a long-term use.

It is lately in fashion to use a cosmetic hard to melt away, a moist cosmetic, etc. However, cosmetic of such a type has a relatively large content of a volatile substance. Therefore, unless the container provides a good airtightness, the cosmetic would be deteriorated. Further, when the airtightness of the container is not excellent, after the cosmetic is accommodated, so-called "slip-out" (a phenomenon that the cosmetic is contracted and consequently slipped out of the cosmetic holder); "desertion" (a phenomenon that the cosmetic cannot effectively cope with movement of the cosmetic holder) and "breakage" (a phenomenon that the cosmetic is contracted and consequently becomes easy to break). In order to prevent such phenomena, airtightness of the container becomes a critical requirement.

SUMMARY OF THE INVENTION

It is therefore an object of the present to provide a cosmetic container capable of smoothly moving a cosmetic without use of any lubricant.

Another object of the present invention is to improve airtightness in a cosmetic container especially using a straight pipe as a main body. With an improved airtightness of the cosmetic container, a volatile cosmetic can be used for a long time without generation of such phenomena as "slip-out", "desertion" and "breakage".

Still another object of the present invention is to provide a novel construction capable of preventing disadvantages which would otherwise be caused by inevitable dimensional errors in manufacturing cylindrical or tubular members constituting the cosmetic container.

Still another object of the present invention is to reduce the number of constituents of the cosmetic container.

In order to achieve these and other objects, according to an aspect of the present invention, there is provided a cosmetic container comprising: a main body provided at a lower portion thereof with slot means extending in a longitudinal direction; an outer body provided with a continuous spiral groove on an inner peripheral surface thereof, the outer body surrounding the main body substantially in close relation to each other but allowing relative rotation therebetween; a cosmetic holder accommodated within the main body substantially in close relation to each other but allowing relative longitudinal sliding movement therebetween, the cosmetic holder being provided with projection means projecting outwardly therefrom through the slot means to be in engagement with the continuous spiral groove so that the cosmetic holder moves longitudinally with respect to the main body in response to rotation of the outer body; a casing surrounding the outer body and rotatable simultaneously with the outer body; a bottom end of the main body being enlarged to form a circumferentially outward projecting bottom extension to be engaged within an annular recess formed cooperatively by lower end portions of the outer body and the casing.

Preferably, the bottom extension of the main body comprises a cylindrical wall portion and an enlarged bead portion formed in a middle of the cylindrical wall portion and projecting outwardly therefrom.

In a preferable embodiment, the outer body has an integral insert sleeve at an upper end portion thereof. The insert sleeve surrounds the main body and rotatable simultaneously with the outer body and the casing.

The casing and the outer body may be ultrasonic-welded, high-frequency-welded or heat-sealed to each other.

A metallic insert sleeve may be mounted to an upper end portion of the outer body made of resin. External projecting means may be formed on the outer body for engagement with internal receiving means formed on the insert sleeve to prevent relative rotation between the outer body and the insert sleeve.

Internal projecting means may be formed on the casing for engagement with external receiving means formed on the insert sleeve to prevent relative rotation between the casing and the insert sleeve.

The cosmetic container may be of a bottom-filling type in which a molten cosmetic is filled through a bottom aperture into the cosmetic holder, or of an insertion type in which a solidified cosmetic is inserted into the cosmetic holder.

BRIEF DESCRIPTION OF THE DRAWINGS

The above and other objects and advantages of the present invention will become apparent to those skilled in the art upon reading of the following description and by reference to the accompanying drawings in which.

DETAILED DESCRIPTION OF THE PREFERRED EMBODIMENTS

Figure 1A:
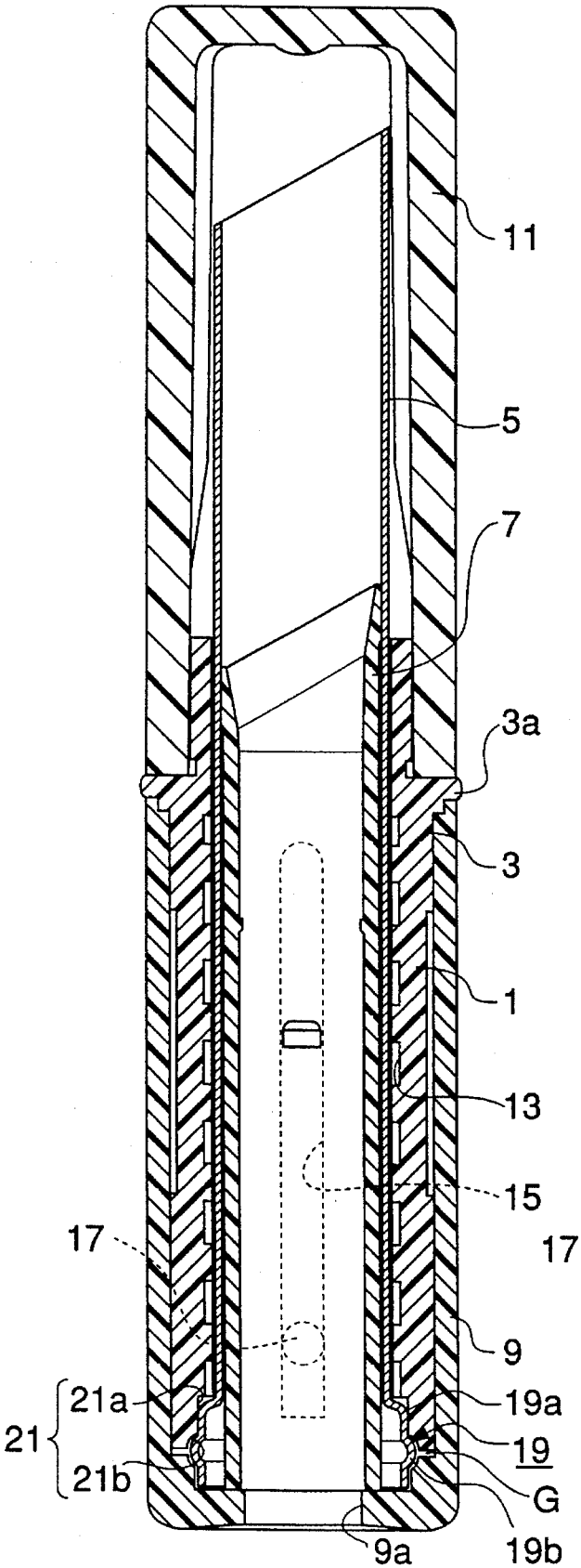
FIGS. 1A and 1B are longitudinal cross-sectional views showing an embodiment of a cosmetic container according to the present invention.
Figure 1B:
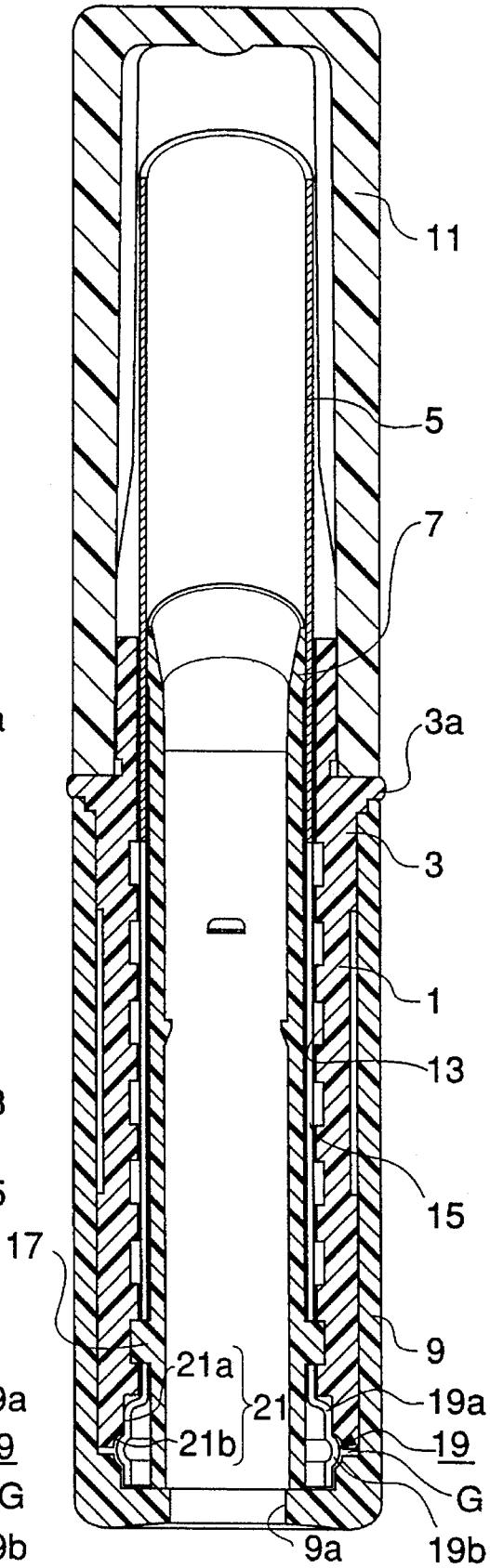
Figure 2:
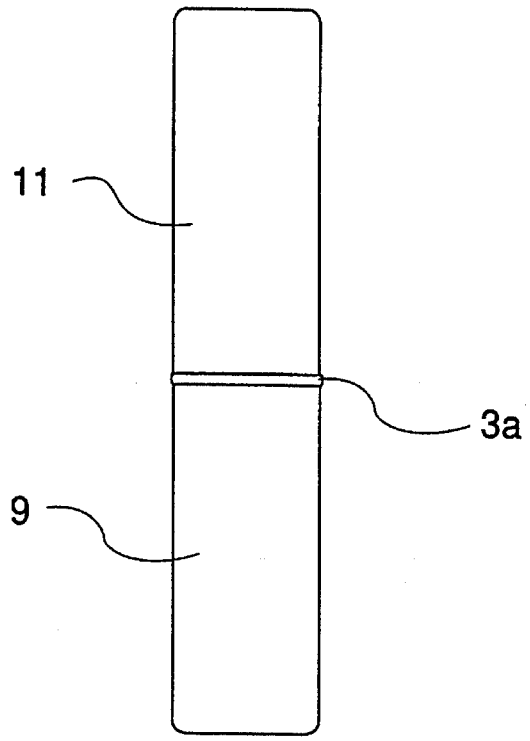
FIG. 2 is a front view diagrammatically showing the cosmetic container of FIG. 1.
Figure 3:
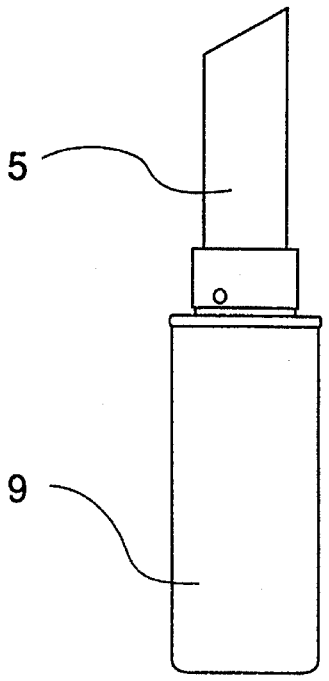
FIG. 3 is a front view diagrammatically showing the cosmetic container of FIG. 1 from which a cap is removed.
Figure 4:
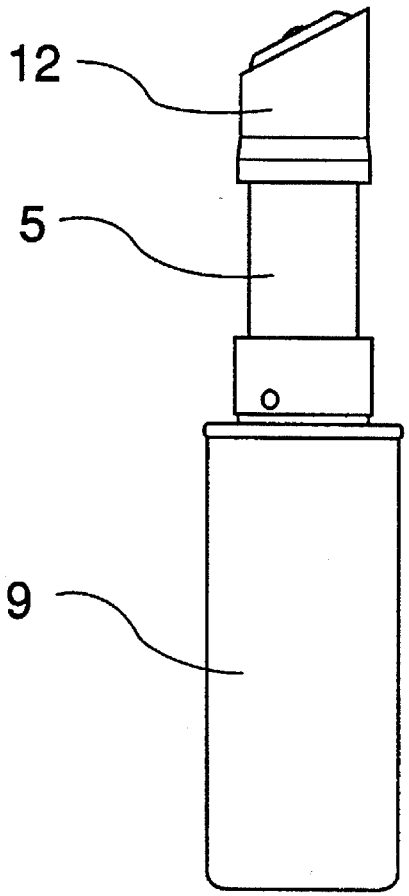
FIG. 4 is a front view diagrammatically showing the cosmetic container of FIG. 1 from which a cap is removed and a capsule is fitted onto a cosmetic holder.

A preferred embodiment of the present invention will be hereinunder described with reference to FIGS. 1 to 4. FIGS. 1A and 1B are longitudinal cross-sectional views taken along vertical planes perpendicular to each other.

A cosmetic container of the illustrated embodiment includes a cylindrical outer body 1 having an upper and lower open ends, a cylindrical main body 5 comprising a straight pipe formed by drawing and a cosmetic holder 7 for receiving a stick-like cosmetic such as a lipstick (not shown). These elements are arranged coaxially. Outer body 1 encircles main body 5 which, in turn, encircles cosmetic holder 7. Cosmetic holder 7 has opposed projections 17 projecting outwardly and passing through longitudinal slots 15 of main body 5 to be engaged with a continuous spiral groove 13 formed on the inner peripheral surface of outer body 1.

Outer body 1 is fixedly received by a casing 9. The upper end portion of casing 9 is ultrasonic-welded to outer body 1. A contacting area between outer body 1 and casing 9 may also be ultrasonic-welded or bonded by adhesion to each other.

Casing 9 has a bottom aperture 9*a* through which a molten cosmetic can be filled into holder 7. When filling the molten cosmetic, the upper open end of main body 5 is closed by a capsule 12 (FIG. 4) to create a mold cavity to be filled with the molten cosmetic. After the cosmetic in the mold cavity is solidified, capsule 12 is removed and bottom aperture 9*a* is closed by sealing means (not shown).

A sleeve 3 is an integral upper end portion of outer body 1 and rotatably contacts with the outer peripheral surface of main body 1. Sleeve 3 has an outwardly projecting flange 3*a* for mounting thereon a detachable cap 11.

Main body 5 is substantially a cylindrical tube having the same diameter but its lower end portion is enlarged to form a circumferentially outward projecting bottom extension 19. Bottom extension 19 has a cylindrical wall portion 19*a* and an enlarged bead portion 19*b* located in the middle of cylindrical wall portion 19*a* and outwardly projecting therefrom. Bottom extension 19 is received within a recess 21 annually formed by cooperation of the lower end portions of outer body 1 and casing 9 located in an opposite relation with a gap G therebetween. More specifically, the inner bottom end of outer body 1 is cut out below spiral groove 13. Similarly, casing 9 is recessed at the inner bottom corner portion. Thus, a cooperative recess 21*a* of outer body 1 and casing 9 surrounds cylindrical wall portion 19*a* of bottom extension 19 of main body 5. At the opposite ends of outer body 1 and casing 9, recesses 21*a* are further recessed to form a cooperative hemispherical recess 21*b* which surrounds enlarged bead portion 19*b* of bottom extension 19. Recess 21 is composed of vertical recess 21*a* and semi-spherical recess 21*b*.

By way of example, outer body 1, casing 9 and cap 11 are made of acrylonitrile styrene copolymer (AS resin), cosmetic holder 7 is made of thermoplastic resin such as polybutylene terephthalate (PBT), and main body 5 is made of aluminum.

With the above-described embodiment, bottom extension 19, especially its enlarged bead portion 19*a* in engagement with vertical recess 21*a* will prevent upward removal of main body 5. In this connection, it is to be noted that the main body of the prior art cosmetic container has a projecting bead 106 for engagement with a corresponding recess of the outer body. If engagement is too tight, there arises a greater frictional resistance between the outer body and the main body to bar relative rotation therebetween during extraction and retraction of the cosmetic. When engagement is loosened to provide a gap between the bead 106 and the recess, the main body tends to be inadvertently removed and separated from the outer body.

In accordance with the present invention, cylindrical wall portion 19*a* received within vertical recess 21*a* will securely prevent removal of main body 5. Moreover, enlarged bead portion 19*b* can be relatively loosely received within semi-spherical recess 21*b* for smooth operation for extraction and retraction of the cosmetic. Recess 21 is formed on two elements, namely outer body 1 and casing 9, with gap G therebetween, for allowing some dimensional errors in manufacturing these elements. Accordingly, the cosmetic container of the present invention has an improved extraction and retraction property and a good airtightness, which may be suitably used to contain a volatile cosmetic.

Figure 10:
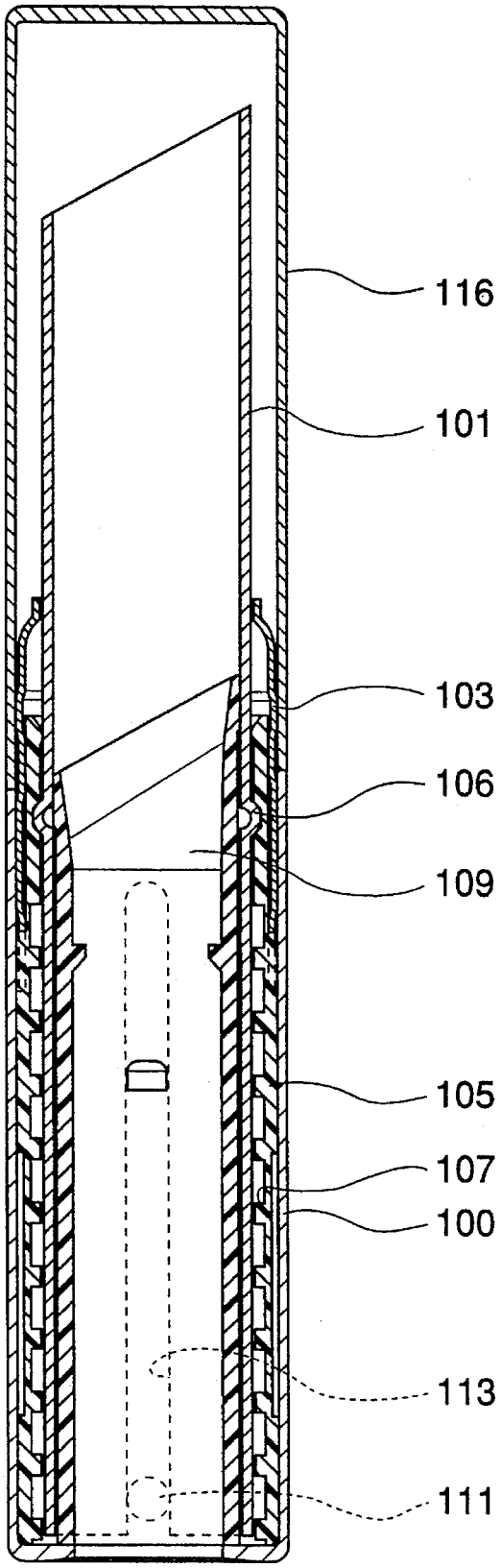
FIG.10 (PRIOR ART)
FIG. 10 is a longitudinal cross-sectional view showing a prior art cosmetic container.

In the above-described embodiment, sleeve portion 3 is formed integral with outer body 1 by monoblock molding of resin. The prior art cosmetic container has an insert sleeve (103 in FIG. 10) as an independent element which is fitted to the outer body. Sleeve portion 3 being formed as an integral part of outer body 1 reduces the number of constituents of the container and improves its strength and stability in posture. Main body 5 can therefore be held in its proper upstanding form.

Figure 5:
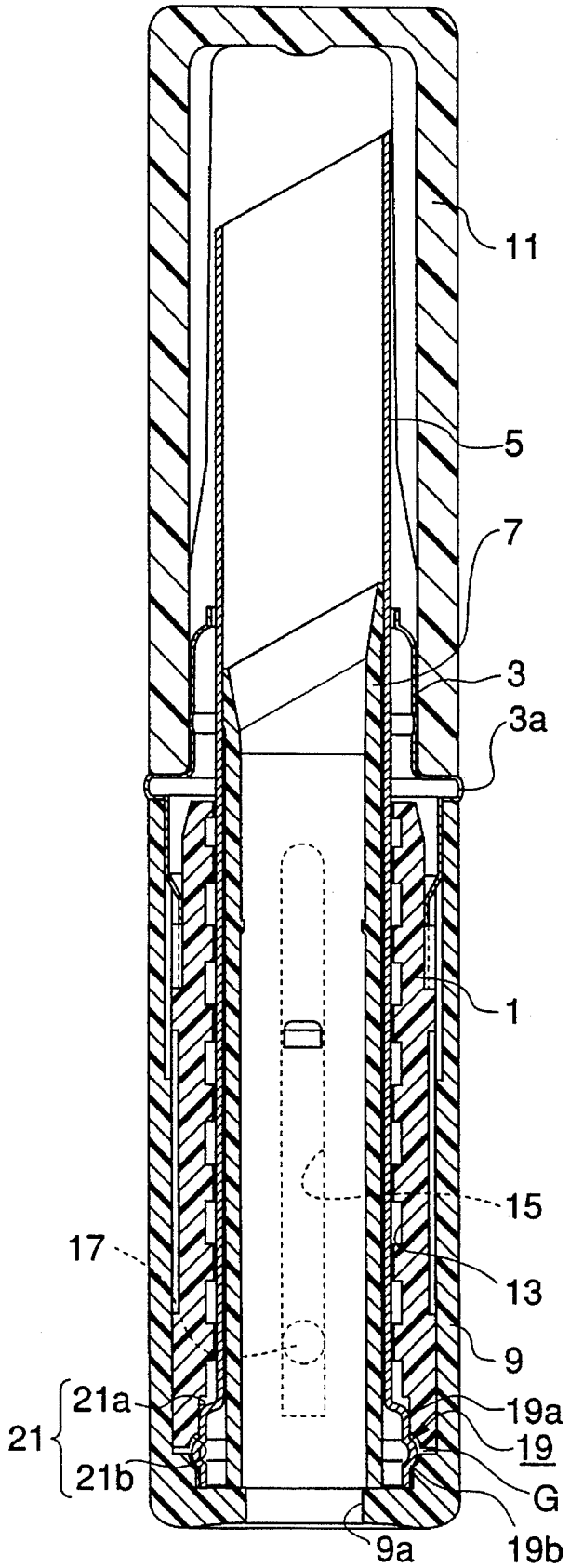
FIG. 5 is a longitudinal cross-sectional view showing another embodiment of the present invention.
Figure 6:
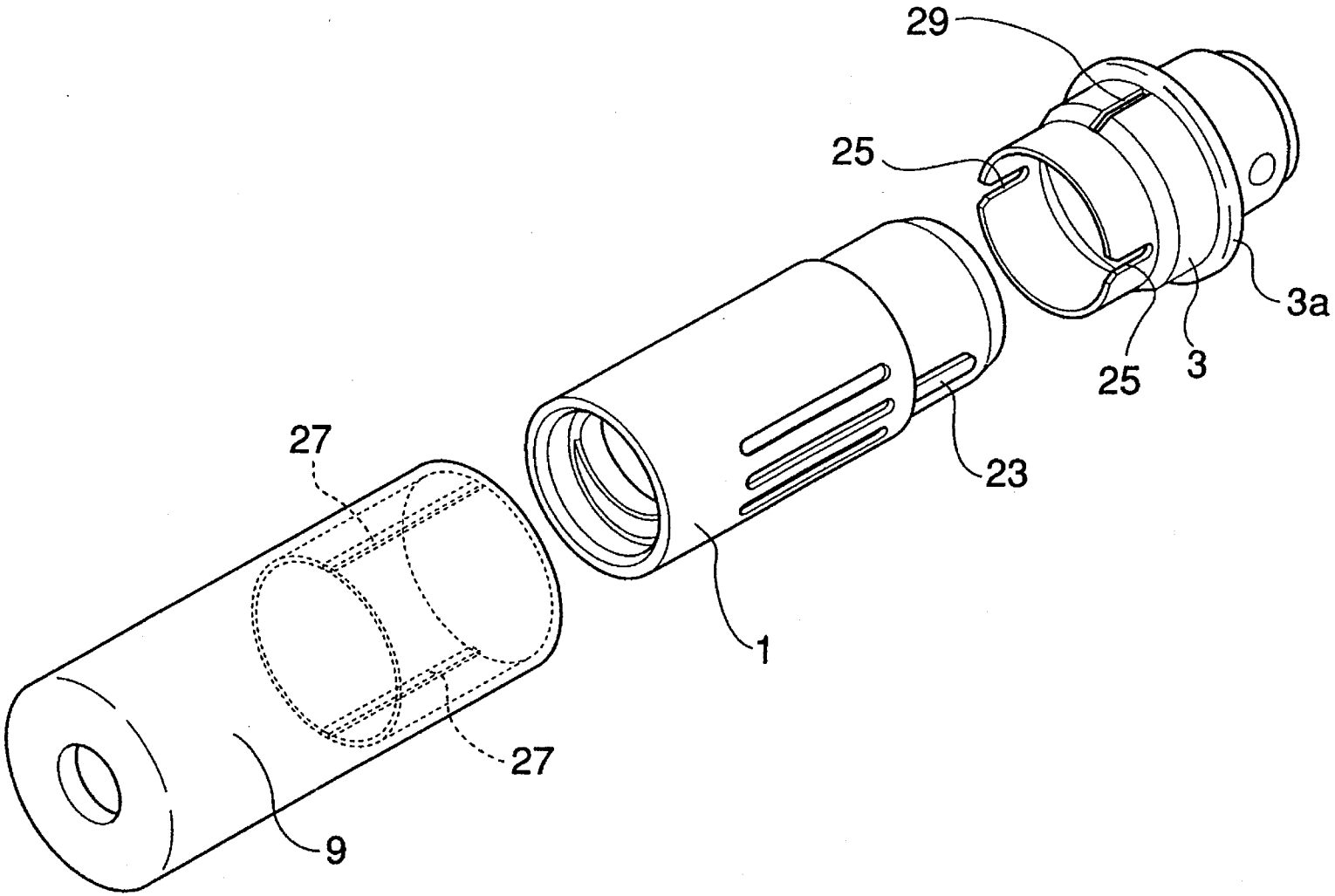
FIG. 6 is an exploded perspective view of the cosmetic container of FIG. 5.

FIGS. 5 and 6 show another embodiment of the present invention. Portions and elements identical to those of the aforesaid first embodiment are accompanied by identical reference numerals and will not be described hereinunder.

In this embodiment, an insert sleeve 3 made of metal such as brass is an independent element of an outer body 1 made of resin. The upper end portion of outer body 1 has a decreased outer diameter, which is provided with a pair of opposed longitudinal ribs 23 for insertion into slits 25 formed in the lower end portion of insert sleeve 3 to prevent relative rotation therebetween. On the inner peripheral surface of a casing 9 are formed a pair of opposed longitudinal ribs 27 for insertion into slits 29 in the middle of insert sleeve 3 to prevent relative rotation therebetween. Thus, casing 9, main body 1 and insert sleeve 3 are assembled such that they are rotated simultaneously as an integral one body. To improve integrity, these elements may be bonded to each other by adhesion.

While the present invention has been described in conjunction with specific embodiments thereof, it is to be understood that no limitation is intended thereby except as defined in the appended claims.

For example, although the illustrated embodiments are so-called bottom-filling type container in which a molten cosmetic is filled through bottom aperture 9*a* into cosmetic holder 7, the present invention is also applicable to a direct-filling type container in which a molten cosmetic is filled through an upper open end of cosmetic holder. The present invention is still applicable to an insertion type container in which a solid cosmetic is inserted from the above into cosmetic holder. In this case, casing 9 has a closed bottom end.

When it is desired to improve airtightness of the cosmetic container, an inner cap is fitted within outer cap 11. In this case, there is provided detachable engagement means between the inner cap and the sleeve portion or insert sleeve 3.

Although it is preferable that main body 3 is a straight pipe formed by drawing, main body 3 may also be a pressing pipe formed by pressing a flat plate.

Casing 9 may be fitted to outer body 1 by adhesion, high-frequency or ultrasonic welding, heat-sealing or any other means.

Slots 25 and/or 29 of insert sleeve 3 may be replaced by longitudinally extending ribs, in which case ribs 23 and/or 27 should be slots receiving the ribs.

Figure 7:
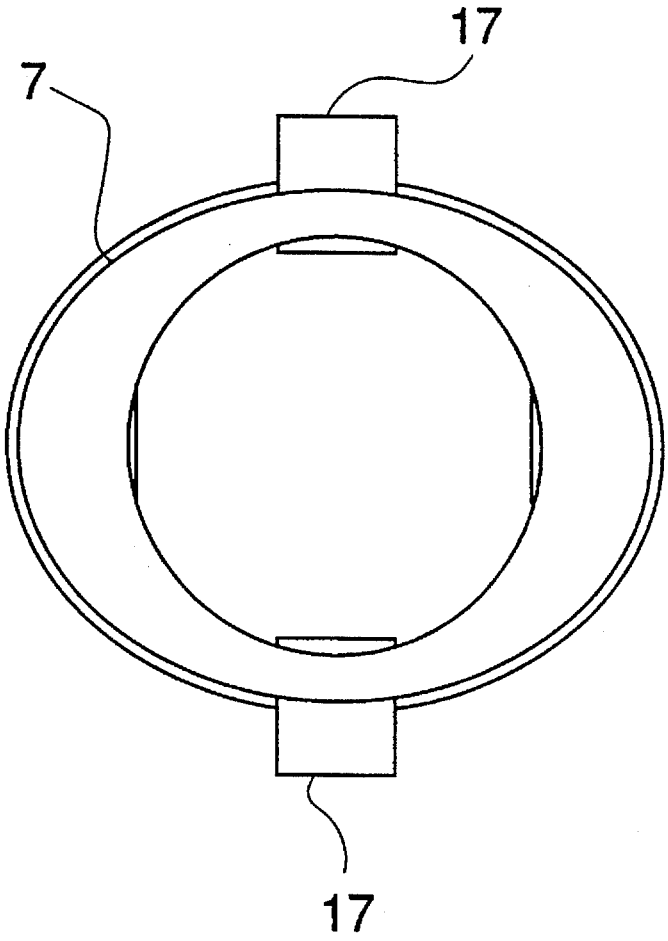
FIG. 7 is a transverse cross-sectional view showing an example of a cosmetic holder usable in the cosmetic container of the present invention.
Figure 8A:
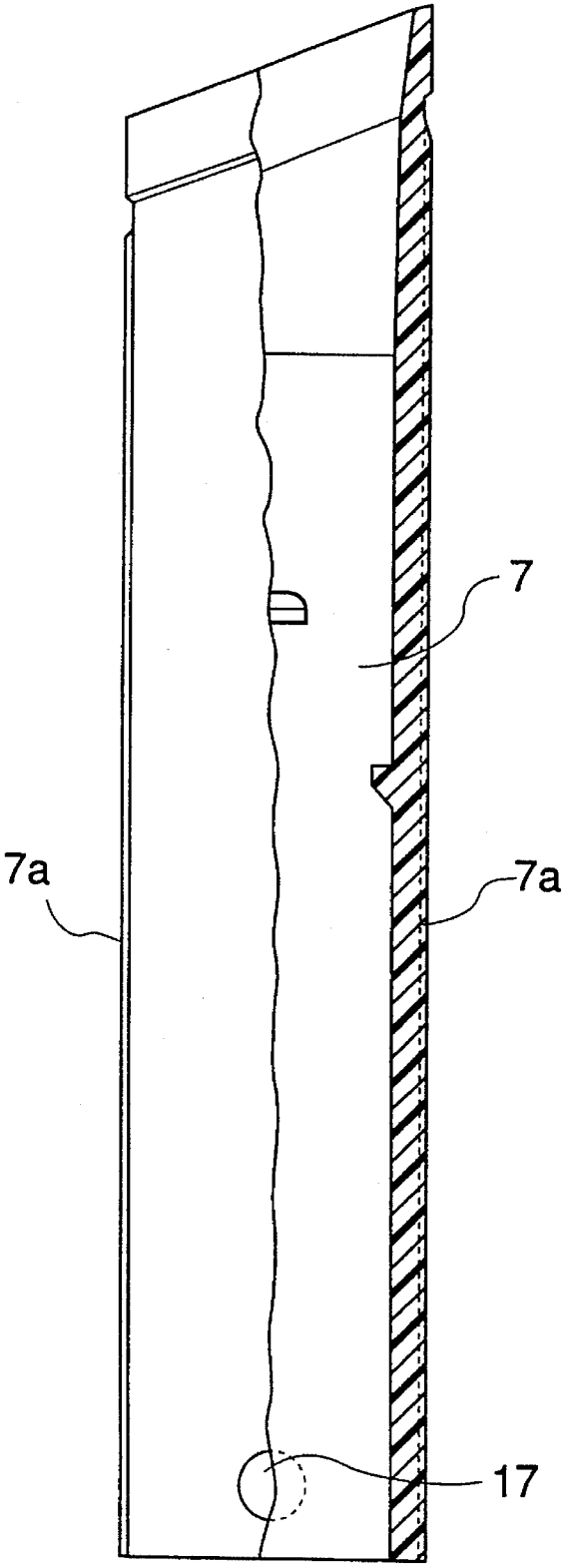
FIGS. 8A and 8B are longitudinal and transverse cross-sectional views showing another example of the cosmetic holder.
Figure 8B:
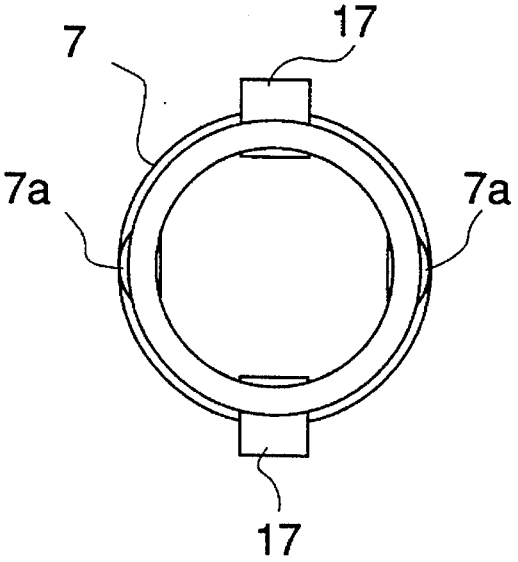
Figure 9A:
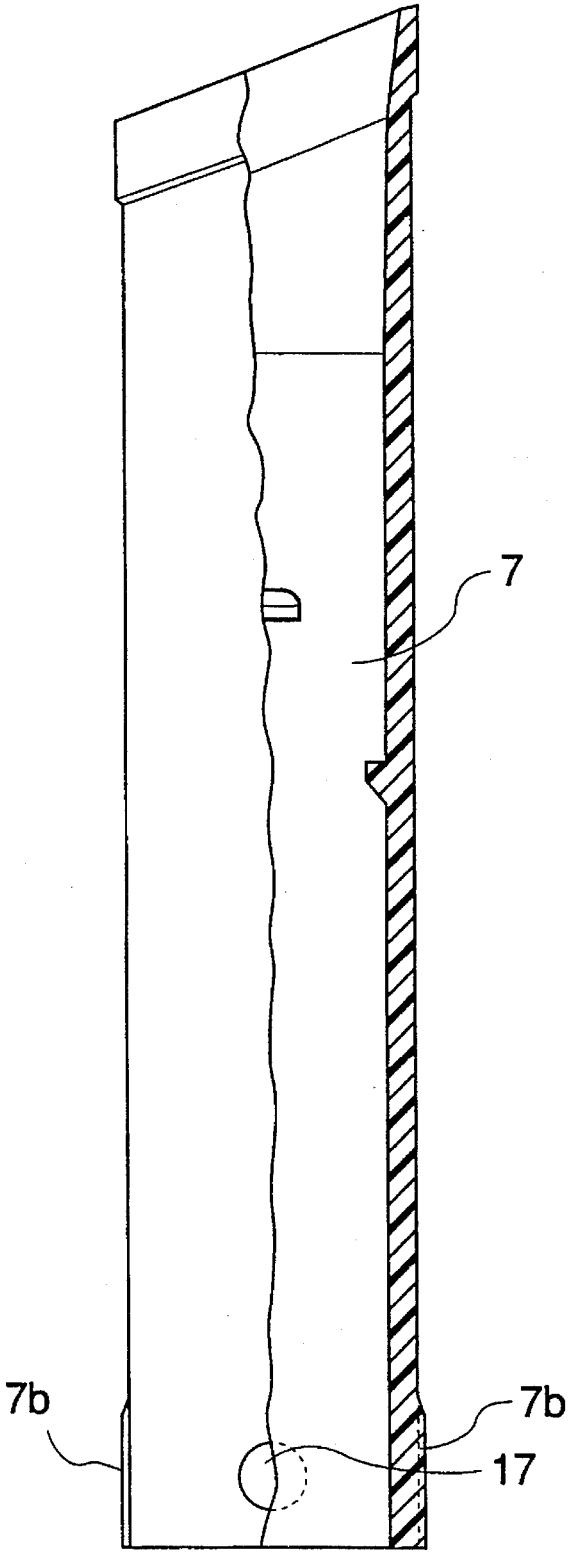
FIGS. 9A and 9B are longitudinal and transverse cross-sectional views showing still another example of the cosmetic holder.
Figure 9B:
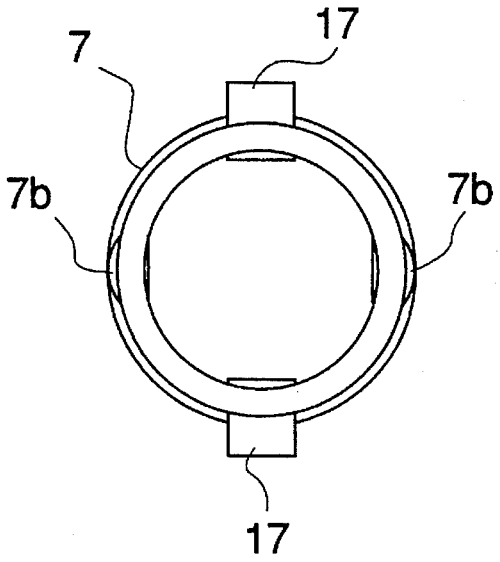

Cosmetic holder 7 may have desired shape and form. For example, it may be oval in cross-section (FIG. 7). It may be provided with a pair of opposed ribs 7*a*, 7*a* extending longitudinally along the outer peripheral surface thereof (FIGS. 8A and 8B). Alternatively, the longitudinally extending ribs may be positioned only at the lower end portion of cosmetic holder 7, which are shown as ribs 7*b*, 7*b* in FIGS. 9A and 9B.

The cosmetic container of the present invention may be used to contain any kind of stick-like cosmetic such as a lipstick and foundation in a solid, paste, gel or any other state.

What is claimed is:

1. A cosmetic container comprising: a main body provided at a lower portion thereof with slot means extending in a longitudinal direction; an outer body provided with a continuous spiral groove on an inner peripheral surface thereof, said outer body surrounding said main body substantially in close relation to each other but allowing relative rotation therebetween; a cosmetic holder accommodated within said main body substantially in close relation to each other but allowing relative longitudinal sliding movement therebetween, said cosmetic holder being provided with projection means projecting outwardly therefrom through said slot means to be in engagement with said continuous spiral groove so that said cosmetic holder moves longitudinally with respect to said main body in response to rotation of said outer body; a casing surrounding said outer body and rotatable simultaneously with said outer body; a bottom end of said main body being enlarged to form a circumferentially outward projecting bottom extension to be engaged within an annular recess formed cooperatively by lower end portions of said outer body and said casing.

2. The cosmetic container according to claim 1 wherein said bottom extension comprises a cylindrical wall portion and an enlarged bead portion formed in a middle of said cylindrical wall portion and projecting outwardly therefrom.

3. The cosmetic container according to claim 1 wherein said outer body has an integral insert sleeve at an upper end portion thereof, said insert sleeve surrounding said main body and rotatable simultaneously with said outer body and said casing.

4. The cosmetic container according to claim 3 wherein said casing and said outer body are ultrasonic-welded to each other.

5. The cosmetic container according to claim 3 wherein said casing and said outer body are high-frequency-welded to each other.

6. The cosmetic container according to claim 3 wherein said casing and said outer body are heat-sealed to each other.

7. The cosmetic container according to claim 1 which further comprises a metallic insert sleeve mounted to an upper end portion of said outer body made of resin, and external projecting means formed on said outer body for engagement with internal receiving means formed on said insert sleeve to prevent relative rotation between said outer body and said insert sleeve.

8. The cosmetic container according to claim 7 which further comprises internal projecting means formed on said casing for engagement with external receiving means formed on said insert sleeve to prevent relative rotation between said casing and said insert sleeve.

9. The cosmetic container according to claim 1 or 7 which further comprises a bottom aperture for filling a molten cosmetic into said cosmetic holder.

10. The cosmetic container according to claim 1 or 7 wherein a solidified cosmetic is inserted into said cosmetic holder.

* * * * *